United States Patent [19]

Tuggle et al.

[11] Patent Number: 4,841,929

[45] Date of Patent: Jun. 27, 1989

[54] PORTABLE ROTARY POWER TOOL

[75] Inventors: Lloyd H. Tuggle; Jeffery G. Sadler, both of Shreveport, La.

[73] Assignee: White Consolidated Industries, Inc., Cleveland, Ohio

[21] Appl. No.: 253,303

[22] Filed: Sep. 30, 1988

Related U.S. Application Data

[63] Continuation of Ser. No. 134,245, Dec. 17, 1987, abandoned.

[51] Int. Cl.[4] ..... B26D 1/553

[52] U.S. Cl. ..... 123/198 E; 30/276; 56/12.7

[58] Field of Search ..... 123/198 E, 195 C; 56/12.7; 30/276

[56] References Cited

U.S. PATENT DOCUMENTS

| | | | |
|---|---|---|---|
| 4,179,805 | 12/1979 | Yamada | 56/12.7 X |
| 4,266,515 | 5/1981 | Bross | 123/195 C X |
| 4,286,675 | 9/1981 | Tuggle | 56/12.7 X |
| 4,733,471 | 3/1988 | Rahe | 30/276 |

OTHER PUBLICATIONS

Consumer Reports, Jun. 1988, vol. 54, No. 6, "String Trimmers", pp. 406-411.

1986 Ryan Lawn Care Products, "Owner and Service Manual", models 265, 285.

*Primary Examiner*—Tony M. Argenbright

*Assistant Examiner*—Eric R. Carlberg

*Attorney, Agent, or Firm*—Hubbard, Thurman, Turner & Tucker

[57] ABSTRACT

A gasoline engine driven flexible line trimmer is provided with a modularly constructed power head section which significantly facilitates the original manufacturing assembly, and subsequent service disassembly, of the power head. In a clutch drive embodiment thereof, the power head has four readily separable modules—an engine module comprising a main engine shroud to which the engine is internally secured; a fan housing module; a starter module comprising a starter housing and a recoil starter mechanism retained therein; and a coupling module comprising a clutch housing carrying therein structure for operatively interconnecting the engine's clutch to the flexible drive shaft disposed within the trimmer shaft. In a direct drive version thereof, the power head has two separable modules—the engine module and a combined fan housing, starter and coupling module defined by a single housing within which the starter and coupling structure is carried. Pull rope installation in the starter mechanism is facilitated and made safer by pulley locking and retaining structure incorporated in the starter module, and improved air filter element sealing is provided by virtue of a specially designed air filter housing and choke plate assembly associated with the carburetor. Shaft vibration transmitted to the trimmer user through the supporting shoulder strap structure is significantly reduced by a specially designed resilient strap connector assembly securable to the trimmer shaft.

26 Claims, 6 Drawing Sheets

PORTABLE ROTARY POWER TOOL

This application is a continuation, of application Ser. No. 134,245, filed 12/17/87, now abandoned.

BACKGROUND OF THE INVENTION

The present invention relates generally to power tools, and more particularly provides a substantially improved power head assembly, and vibration reducing apparatus, for a portable rotary power tool such as a flexible line trimmer.

Portable, gasoline engine driven rotary power tools such as brush cutters, lawn edgers, flexible line trimmers and the like typically comprise an elongated hollow shaft to one end of which a rotary cutting assembly is operatively mounted. A power head assembly, including the engine, is mounted on the opposite end of the shaft and typically comprises a protective shroud structure which envelops all or part of the engine, a gas tank, and a recoil starting mechanism incorporating the usual starter rope and pull handle components. The engine drives the cutting assembly, either directly or through a clutch mechanism, via a flexible drive shaft structure extending through the hollow shaft. To assist in properly guiding the cutting element during tool use, a pair of operator handle elements are typically secured to the tool in appropriate locations thereon. Additionally, a shoulder strap is often used to support the weight of the tool, the strap having an outer end portion which is releasably connectable to a small rigid clamp member or the like secured to the shaft.

While gasoline driven tools of this general type and configuration have proven to be quite useful, and immensely popular, a variety of problems, limitations and disadvantages may still be found in many of them relating to, among other things, structure, operation, safety, fabrication cost effectiveness, operating comfort, and maintenance and service accessability.

For example, because of the need to design the power head assembly to be at the same time light in weight, compact, and cost effective from material and fabrication standpoint, the resulting power head assembly can be frustratingly difficult and laborious for the average consumer to work on. Even minor engine adjustments, such as resetting the carburetor idle and operating speed adjustment screws, is often annoyingly hindered by the need to disassemble and remove various other power head components to even reach the carburetor. At the other end of the maintenance spectrum, major engine teardown and removal is often simply beyond the capabilities of the average tool user due to the sheer complexity and intricacy with which many conventional power heads of this general type are of necessity assembled.

Conventional attempts to alleviate to some degree this component access problem have, in many instances, left certain engine components exposed in a manner, though increasing their accessability, increasing the likelihood that such exposed components will be accidentally bumped and damaged during tool use, and giving the overall power head a somewhat ungainly and "jury rigged" exterior appearance. As but one example of this problem, the engine's carburetor and associated air filter structure are often allowed to protrude outwardly of the engine's shroud structure for accessability purposes, thereby rendering these components highly vulnerable to damage.

Another example, relating both the component accessability and safety, arises in conjunction with the recoil starter mechanism which is typically difficult to remove and, when the need arises to replace its starter rope, difficult, awkward and sometimes unsafe to work on. As is well known, the problem here lies with the conventional necessity of hand winding the starter pulley against the biasing force of its associated torsion spring, and then holding the wound-up pulley with one hand, to keep the torsion spring from flying off, while attempting to rethread and knot a new starter rope onto the pulley with the other hand.

Apart from these and numerous other problems typically associated with conventional power head sections of tools of this general type, it has been found that a surprisingly high amount of shaft vibration is often transmitted to the tool operator's body through the shoulder strap secured to the tool shaft despite the flexibility of the strap. This transmitted vibration can be both annoying and tiring, and it would be quite desirable to eliminate or at least substantially reduce it in a simple, inexpensive manner.

In view of the foregoing, it is accordingly an object of the present invention to provide improvements which eliminate or minimize above-mentioned and other problems, limitations and disadvantages commonly associated with conventional portable rotary power tools of this general type.

SUMMARY OF THE INVENTION

In carrying out principles of the present invention, in accordance with preferred embodiments thereof, a representative internal combustion engine driven portable rotary power tool, in the form of a flexible line trimmer, is provided with a modular power head assembly mounted on one end of the hollow trimmer shaft and utilized to rotationally drive a cutting head assembly mounted on the opposite end of the shaft.

In one embodiment thereof, the power head assembly is formed, proceeding from back to front along the assembly, from four releasably interconnected modules—an engine module, a fan housing module, a starter module, and a coupling module.

The engine module comprises a specially designed shroud having an open front end, a top wall, a bottom wall, a pair of opposite side walls, a thickened upper rear support wall section which is forwardly inset and extends downwardly from a central portion of the top wall, and a vertically intermediate wall which extends rearwardly from the bottom of the support wall and defines with rear portions of the bottom and side walls a muffler chamber having an open back end over which a suitable muffler guard may be connected.

The top wall of the shroud is downwardly inset to form a top well portion of the shroud, and the open bottom end of a shell member is sealingly secured to the periphery of the well portion to define therewith a fuel tank portion of the engine module.

A rear portion of the top wall defines with the intermediate wall and the support wall a back end recess in the shroud. A carburetor and an associated air filter housing are disposed within this recess to protect these components from damage, while at the same time providing easy access thereto. The carburetor is secured to the outer surface of the support wall over a fuel-air mixture passage extending inwardly therethrough, a reed valve member being operatively mounted on the interior surface of the support wall over the inner end of the fuel-air mixture passage.

The engine module also comprises a small single cylinder, air cooled, two stroke cycle gasoline engine having a crankcase with an open rear end portion, a piston and cylinder assembly secured to and depending from the crankcase, and a muffler operatively supported on the cylinder and projecting rearwardly therefrom. The crankcase, cylinder and muffler portions of the engine are disposed within the shroud and are removable through its open front end. The open rear end of the crankcase is bolted to the interior surface of the thickened support wall, over the reed valve thereon, so that such support wall supports the engine and defines a rear closure wall of the crankcase. The cylinder extends below the intermediate shroud wall, with the muffler projecting rearwardly into the muffler chamber. The engine's crankshaft projects forwardly through and beyond the open front end of the shroud, and is provided at its forward outer end with a centrifugal clutch assembly captively retained on the crankshaft by a nut threaded onto the outer crankshaft end.

The fan housing module comprises a fan housing section removably secured to the shroud around its open front end and enclosing the engine's flywheel which coaxially circumscribes and is rotationally locked to the crankshaft forwardly of the crankcase. The flywheel is provided with a circumferentially spaced series of axially extending cooling impeller blades which, during engine operation, flows a supply of ambient cooling air rearwardly across the cylinder and outwardly through the muffler chamber, the ambient cooling air mixing with exhaust gas discharged from the muffler to cool the exhaust gas. The exhaust gas-cooling air mixture being discharged rearwardly through perforations in the muffler guard.

The starter module comprises a starter housing having a front wall, a side wall section extending rearwardly from the periphery of the front wall, and an open back end portion, the starter housing being releasably connected to the open front end of the fan housing. A tubular support post projects rearwardly from the front wall of the starter housing and circumscribes a portion of the engine's crankshaft between the clutch assembly and the flywheel. Carried within the starter housing is a manual, recoil type starting system which includes a starter pulley rotatably carried on the support post and having front and rear flanges between which a starter rope is wound, an outer end portion of the starter rope extending outwardly through a grommeted opening in the starter housing and being operatively connected to a starter pull handle.

A hollow cylindrical drive hub projects rearwardly from a central portion of the rear flange and is provided with drive teeth operatively engageable with spring biased starter dogs mounted on a forward portion of the flywheel. An annular torsion spring circumscribes the support post, is operatively connected to the starter pulley, and is retained between the starter housing front wall and the front pulley flange. The starter pulley is received within a generally annular guide channel defined by guide members projecting rearwardly from the front starter housing wall. The pulley is captively retained on the support post by a small retaining tab member secured to a thickened portion of the starter housing by a small screw member. Accordingly, when the starter module is removed from the balance of the power head assembly, both the starter pulley and its associated torsion spring are retained within the starter housing.

The installation of a starter rope on the starter pulley is made significantly easier and safer by the pulley and spring retaining operation of the tab member in conjunction with circumferentially alignable notches formed in the periphery of the rear pulley flange and one of the pulley guide members. To install a starter rope on the pulley, the pulley is wound up against the biasing force of the torsion spring and then backed off approximately one turn until these two notches are brought into alignment. A small pin member or the like may then be inserted between the aligned notches to lock the pulley against rotation caused by the wound up spring. Both of the operator's hands are then freed to easily and safely install the starter rope. After the rope has been installed, the locking pin member may be removed to allow the spring to unwind and automatically wind the new rope onto the starter pulley.

The coupling module, which is releasably connectable to the front side of the starter module, comprises a clutch housing which envelops the engine's centrifugal clutch assembly and is provided at its front end with an internal, rearwardly projecting support shaft portion into which is molded a bearing structure including an annular bearing and an annular bearing spacer. This bearing structure coaxially receives and rotatably supports a cylindrical coupling member which is rotationally locked at a front end thereof disposed within the support shaft portion to an end of the flexible drive shaft which extends through the tubular trimmer shaft and is used to drive the trimmer's cutting head assembly. A clutch drum is fixedly secured to the rear end of the coupling member and outwardly circumscribes the centrifugal clutch assembly. When the rotational speed of the engine reaches a predetermined level, friction portions of the clutch assembly are moved radially outwardly therefrom to frictionally engage the interior surface of the clutch drum to thereby rotate the flexible drive shaft.

This modular power head assembly greatly simplifies, in a very cost effective manner, the access to and servicability of the internal power head components. For example, simply by removing the coupling module, the centrifugal clutch assembly is readily accessible, yet is conveniently held on the balance of the power head assembly by the retaining nut on the outer end of the crankshaft. The exposed clutch assembly also captively retains the starter and fan housing modules on the shroud. By removing the clutch assembly, the starter assembly may simply be pulled outwardly off the front end of the crankshaft. Additionally, by then removing the fan housing screws and the fan housing, both the flywheel and its associated ignition module are exposed for inspection and service. The entire engine may then be removed simply by disconnecting it from the shroud support wall and pulling it outwardly through the open front end of the shroud. The carburetor and its associated air filter structure, which are disposed in the protective shroud recess and accessible therethrough, may also be simply disconnected from the shroud's specially designed supporting wall.

In a direct drive embodiment of the power head assembly the centrifugal clutch assembly is eliminated, and a single fan housing and starter module is removably secured to the open front end of the shroud. This single, forwardly disposed module comprises a unitary housing section in which the recoil starter system is captively retained, and a coupling member is carried to drivingly interconnect the inner end of the flexible drive shaft and the outer end of the crankshaft.

In another version of the power head assembly, the shroud is modified by eliminating the upper shroud well portion and a rear portion of the shroud's upper wall. A separate fuel tank is suitably secured atop a front upper portion of the shroud and has a rear portion which extends rearwardly of the shroud support wall and is spaced upwardly from the intermediate shroud wall to define therewith the protective recess within which the carburetor and its associated air filter structure are disposed. In yet another version of the power head assembly, the shroud is modified in essentially this same manner, and an operator handle is secured to and positioned above the power head assembly. The operator handle has a front end portion which is connected to the housing structure disposed forwardly of the shroud, and a rear portion defined by a fuel tank which is suitably secured to an upper portion of the shroud and overhangs the carburetor and its associated air filter structure.

According to a feature of the present invention, a specially designed carburetor choke plate and air filter assembly is provided which comprises a choke plate that is positioned against the back end of the carburetor and is secured to the shroud support wall in a manner clamping the carburetor thereto over the fuel-air mixture passage extending through the support wall. The choke plate is secured within the open front end of an air filter housing and is provided with a choke lever pivoted to its rear side and having an inner end portion movable over a central choke opening in the plate to selectively block and unblock the same. A detent projection is formed on the choke lever and cooperates with complementarily configured detent depressions formed on the back side of the choke plate to releasably hold the lever in a selected one of three available choke positions.

The air filter housing has a side wall portion with a series of air inlet openings formed therein, and internally supports a bent strip of foam type air filter material. An outer end portion of the choke lever projects outwardly through a notch in the filter housing and is sealingly engaged by a front side edge portion of the bent filter material strip. As the lever is pivoted relative to the choke plate, the side edge portion of the filter element strip is deformed to provide a dust seal around the outer end portion of the choke lever in its new pivoted position.

According to another aspect of the present invention, a specially designed connector assembly is provided to connect an operator shoulder strap to the trimmer shaft, and functions to substantially reduce shaft vibration transmitted to the operator through the strap. The connector assembly comprises a first essentially rigid member adjustably securable to the trimmer shaft; a second essentially rigid member to which the shoulder strap may be secured; a hollow, resiliently flexible vibration damping member; and connecting means for connecting the first and second members to opposite ends of the hollow damping manner in a manner isolating the first and second members from contact with one another and causing shaft vibration transmitted through the first member to the damping member to cause flexure of the damping member and to be absorbed thereby.

DETAILED DESCRIPTION

Figure 1:
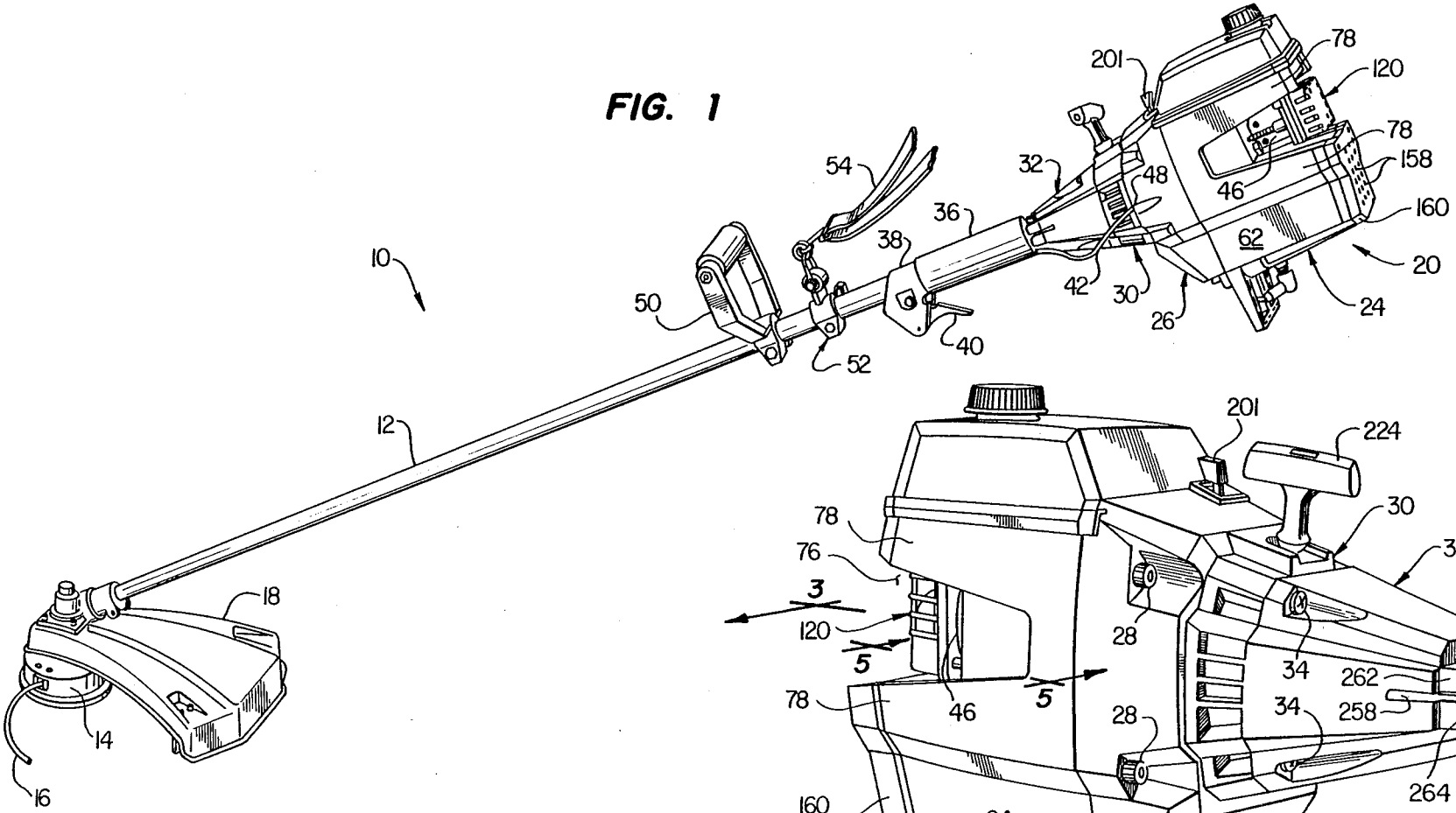
FIG. 1 is a perspective view of a gasoline engine powered flexible line trimmer that incorporates a variety of structural, operational, maintenance and service accessibility, cost reducing, and other improvements embodying principles of the present invention.
Figure 2:
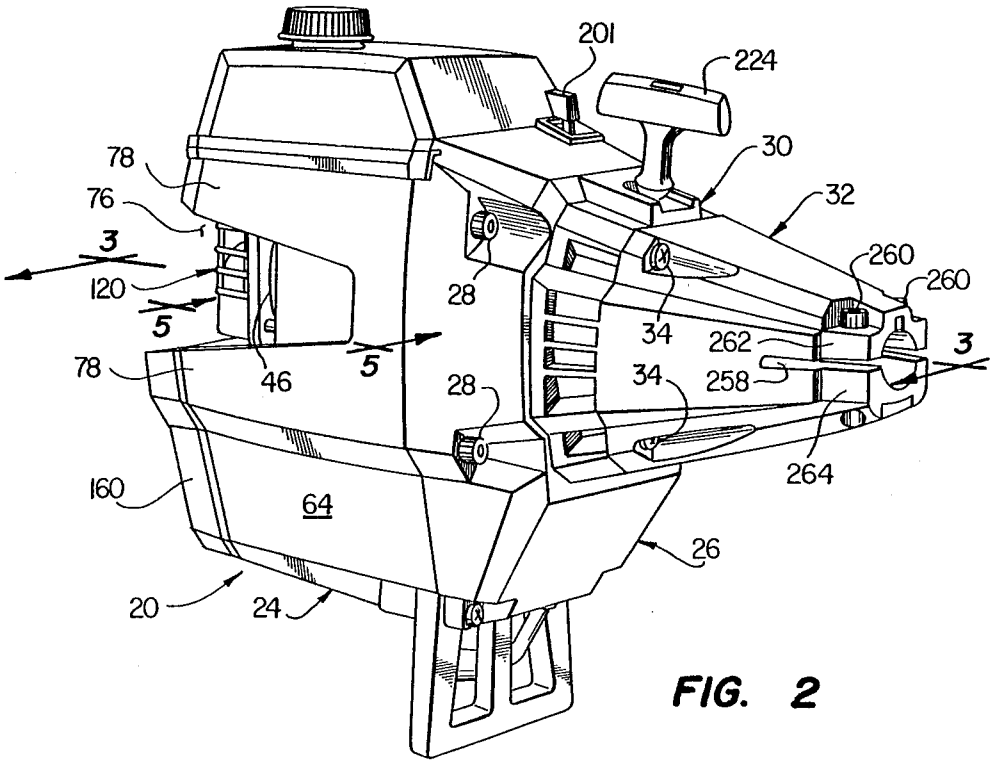
FIG. 2 is an enlarged scale perspective view of the power head section of the trimmer.

In a preferred embodiment thereof, the present invention provides a portable rotary power tool, in the form of a flexible line trimmer 10 perspectively illustrated in FIG. 1, in which a variety of unique structural, operational, maintenance and service accessibility, cost reducing, and other improvements are provided. Trimmer 10 has an elongated hollow shaft 12 which has operatively mounted on its left or forward end a rotationally drivable cutting head assembly 14 which is rotated at a high speed to spin an outwardly projecting flexible trimming line segment 16 in a cutting plane which is essentially transverse to the rotational axis of the head 14, and is utilized to trim various types of vegetation into which the cutting plane is moved. To protect the trimmer operator from the rapidly whirling line segment 16, a protective shield member 18 is also secured to the outer end of shaft 12, the shield member 18 being positioned generally above the cutting plane and projecting rearwardly toward the operator. To transmit rotational power to the cutting head assembly 14, a uniquely configured and operative power head assembly 20 is mounted on the right or inner end of the shaft 12. A small, single cylinder internal combustion engine 22 (FIG. 3) is disposed within a multi-section molded plastic shroud and housing structure which, as also illustrated in FIG. 2, comprises a main shroud 24, positioned at the rear of the powerhead assembly 20; a fan housing 26 removably secured to a front side portion of the shroud 24 by mounting screws 28; a starter housing 30 positioned at the front side of the fan housing; and a clutch housing 32 projecting forwardly from the starter housing and secured to an inner end portion of the shaft 12 in a manner subsequently described. Elongated mounting screws 34 are extended through a rear portion of the clutch housing 32, through the starter housing 30 and into a front portion of the fan housing 26 to thereby removably mount the housings 30, 32 on the fan housing 26.

Figure 5:
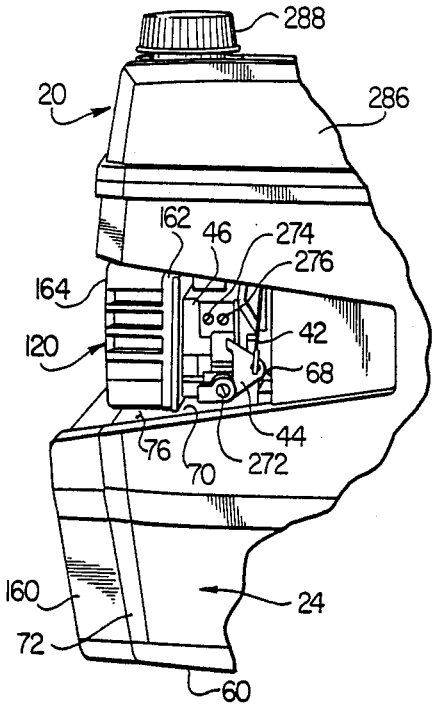
FIG. 5 is a fragmentary side elevational view of a rear portion of the power head section taken generally along line 5—5 of FIG. 2.

Coaxially circumscribing the shaft 12 immediately adjacent the outer end of the clutch housing 32 is a hollow cylindrical rear operator handgrip 36 which is formed from a suitable resilient material. At the forward end of the handgrip 36 a molded plastic throttle lever housing 38 which is removably clamped to the shaft 12, and is provided with a pivotally mounted throttle lever 40 operatively connected, via a cable element 42, to the pivotally mounted throttle arm portion 44 (FIG. 5) of the engine's externally mounted carburetor 46. The cable 42, as best illustrated in FIG. 1, is extended through an axial passage (not illustrated) formed in the handgrip 36, and then enters the fan housing 26 at location 48. As best illustrated in FIG. 5, the cable 42 exits the rear shroud 24, adjacent the carburetor 46, and is connected at an end portion thereof to the throttle arm 44.

Clamped to the shaft forwardly of the throttle lever housing 38 is a forward operator handle 50 which is used by the trimmer operator in conjunction with the rear handgrip 36 to precisely control the movement of the trimmer cutting plane. Also clamped to the shaft 12, between the housing 38 and the control handle 50, is a specially designed, vibration reducing shoulder strap connector assembly 52 which, in a manner subsequently described is connectable to an operator shoulder strap 54, the strap 54 being used by the operator in a conventional manner to assist in comfortably supporting the weight of the trimmer 10.

Figure 3:
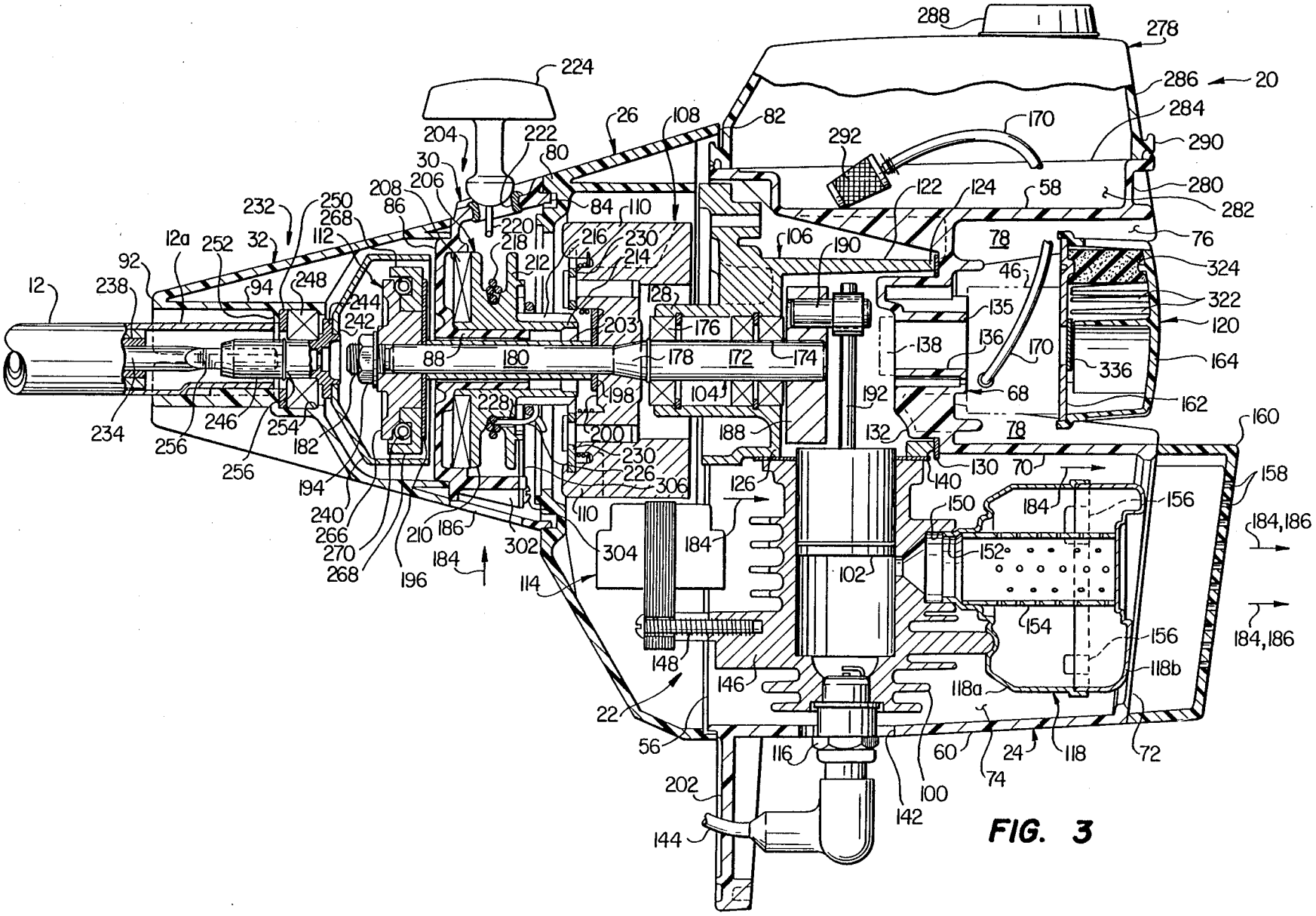
FIG. 3 is an enlarged scale, partially cross-sectional, and partially elevational view taken through the power head section along line 3—3 of FIG. 2, with certain engine components within the power head being schematically depicted.
Figure 4:
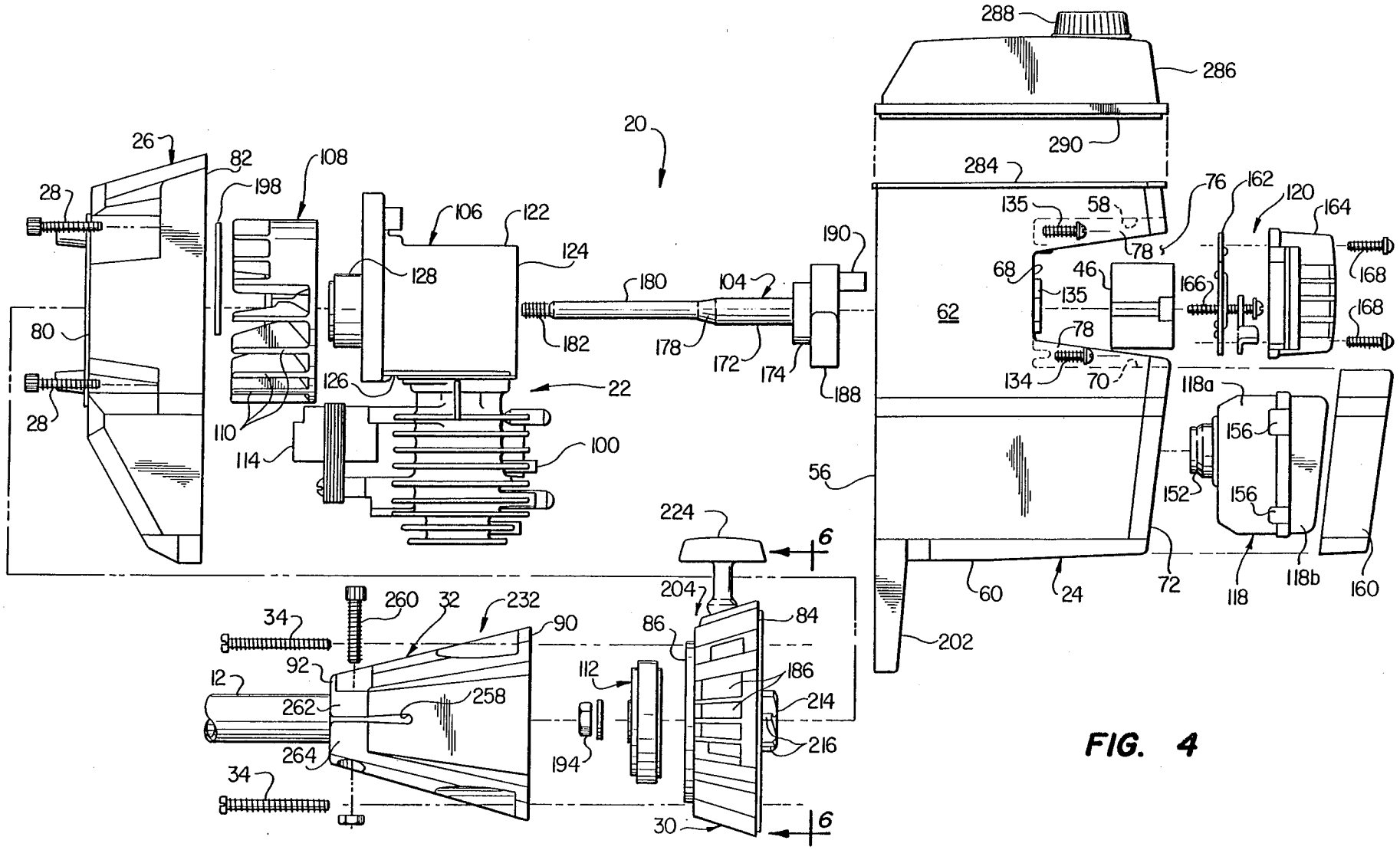
FIG. 4 is a somewhat simplified exploded side elevational view of the power head section, with certain portions thereof being omitted for illustrative purposes.

Referring now to FIGS. 2-4, it can be seen that the shroud and housing portions 24, 26, 30 and 32 are "stacked" in a front-to-rear direction along the rear end of the shaft 12 and, as previously mentioned, are easily separable from one another by removing the mounting screws or bolts 28 and 34. In side elevation, the main shroud 24 has a generally rectangular configuration, while an upper portion of the fan housing 26 combines with the fan and clutch housings 30, 32 to provide the overall housing structure with a generally frustroconically-shaped forward nose portion that gives the multi-section housing structure a pleasing, streamlined configuration.

The main shroud 24 has an open front end 56, and a vertically elongated, generally rectangular cross-section defined by an upper wall 58, a lower wall 60, and a pair of side walls 62 and 64. Extending downwardly from the upper shroud wall 58 is a substantially thickened upper rear wall section 68 that is connected at its lower side to a rearwardly extending vertically intermediate wall 70.

The interior of the main shroud 24 opens outwardly through the open front end 56 thereof, and additionally opens outwardly through a lower rear end opening 72 defined by lower side portions of the side walls 62 and 64, the intermediate wall 70, and a rear portion of the lower wall 60, these particular wall portions defining in the shroud 28 a lower rear internal cavity 74. Additionally, an upper rear recess 76 is formed in the shroud 24 by the wall section 68, the vertically spaced walls 58 and 70, and sloping rear tab portions 78 of the side walls which are spaced vertically apart from one another and project inwardly beyond the walls 58 and 70. As illustrated, the upper rear recess 76 is accessible from the back of the shroud 24, and from the opposite sides thereof between opposed pairs of the side wall tab portions, and is bounded at its inner end by the thickened upper rear wall section 68.

The fan housing 26 which is secured as previously described to the front end 56 of the main shroud 24, has an open front end 80, and an open rear end 82. The starter housing 30 has an open rear end 84 and a front wall 86 from a central portion of which a hollow cylindrical support post member 88 rearwardly extends. The forwardly and laterally inwardly tapered clutch housing 32 has an open rear end 90, and an open front end 92 from which a hollow cylindrical support shaft portion 94 rearwardly extends.

Referring now primarily to FIGS. 3 and 4, the engine 22 is a single cylinder, air cooled, two stroke cycle engine, which, with the exception of certain components subsequently described is disposed within the multi-section shroud and housing structure described above. The primary components of the engine 22 comprise a finned cylinder 100; a piston 102 received in the cylinder for reciprocation therein along a vertical axis as viewed in FIGS. 3 and 4; a crankshaft assembly 104; a crankcase 106; a flywheel 108 having a circumferentially spaced series of axially extending cooling impeller blades 110 thereon; a centrifugal clutch assembly 112; an ignition module 114; a spark plug 116; a muffler 118; the carburetor 46; and an air filter housing and choke plate assembly 120. Crankcase 106 has a hollow rear portion 122 with an open back end 124, an open lower side 126, and a forwardly projecting, hollow cylindrical bearing support portion 128.

As will be seen, the main shroud 24, in addition to enveloping and protecting a rear portion of the engine 22, uniquely performs a variety of functions in the powerhead assembly 20. One of these important functions, performed by the shroud's thickened wall section 68 is to mount and support the engine 22 as will now be described. The open back end portion 124 of the crankcase 106 is bolted, over a gasket 130, to the inner side surface of the thickened wall section 68, around an inwardly projecting boss portion 132 thereof, by means of four mounting bolts 134 (only two of which are visible in FIG. 4) which are positioned in the rear shroud notched area 76 and are extended forwardly through the wall section 68 and fastened into the crankcase end portion 124.

The thickened wall section 68 also serves to externally mount, within the notched area 76, the carburetor 46 and the filter and choke plate assembly 120, in a manner subsequently described, the carburetor 46 abutting a rearwardly projecting end portion 135 of boss 132 as best illustrated in FIG. 3. It can be seen in FIG. 3 that this thickened wall section 68 defines a rear closure wall of the rear portion 122 of crankcase 106, while a suitably configured boss opening 136 also defines a fuel-air mixture passage which interconnects the carburetor outlet with the interior of the rear crankcase portion 122. The boss 132 also is conveniently used to mount, over the inner end of the passage 136 a schematically depicted crankcase reed valve 138. Before describing various other functions performed and advantages provided by the main shroud 24, a detailed description of the interconnection and relative positioning of the previously mentioned engine components will now be given.

The upper end of the finned cylinder 100 is suitably bolted, over a sealing gasket 140, to the open lower side 126 of the crankcase 106, with the bottom-mounted spark plug 116 projecting downwardly through a suitable opening 142 formed in the lower shroud wall 60. Spark plug 116 is operatively connected to the ignition module 114 by suitable wiring 144, the ignition module being positioned generally within a lower portion of the fan housing 26, and being secured to a forwardly projecting connecting block portion 146 of the cylinder 100 by an elongated mounting screw 148.

Cylinder 100 is provided in a right side portion thereof with a suitably configured exhaust gas discharge opening 150 which receives the inlet end 152 of the muffler 118. Exhaust gas discharged from the cylinder 100 is flowed through the outlet opening 150 into a perforated cylindrical muffler liner 154 into the interior of the muffler body. The muffler body is formed from two partially nested horizontal sections $118_a$ and $118_b$, the section $118_a$ having outwardly deformed portions which define side outlets 156 in the muffler body. Exhaust gas entering the interior of the muffler body through the liner 154 is discharged rearwardly through these side outlets 156 and then flowed rearwardly through rear wall perforations 158 formed in a hollow molded plastic muffler guard 160 secured to the shroud 24 over its lower rear end opening 72.

The filter and choke plate assembly 120 includes a metal choke plate 162 positioned rearwardly of the carburetor 46, and an air filter housing 164 positioned rearwardly of the choke plate. The plate 162 is secured to the thickened shroud wall section 68 by a pair of elongated mounting screws 166 which draw the plate 162 against the back end of the carburetor 46 to clamp it into operative engagement with the rearwardly projecting boss portion 134 so that the fuel-air mixture produced by the carburetor flows into the crankcase via the boss opening 136 and across the reed valve 138. The filter housing 164 is secured to the choke plate 162 by means of a pair of mounting screws 168 extended through the filter housing 164 and fastened into the choke plate 162. Fuel is supplied to the carburetor 46, in a manner subsequently described, through a flexible fuel line 170.

Crankshaft assembly 104 has a relatively large diameter inner longitudinal shaft section 172 which extends coaxially through the crankcase bearing support portion 128 and is rotatably supported therein by a bearing structure that includes an inner crank bearing 174 carried by the shaft section 172, and an outer crank bearing 176 retained within an outer end portion of the bearing support portion 128 which projects forwardly into the fan housing 26. The left end of the inner shaft section 172 tapers, as at 178, to a smaller diameter outer longitudinal shaft section 180 which extends centrally through the starter housing 30 and into the clutch housing 32, and is provided with an externally threaded outer end portion 182.

The flywheel 108 is positioned within the fan housing 26 and coaxially circumscribes a longitudinally central portion of the crankshaft including its tapered portion 178. The flywheel is keyed or otherwise rotationally locked to the crankshaft for rotation therewith, and its impeller blades 110 function during flywheel rotation by the crankshaft to draw ambient cooling air 184 into the interior of the power head assembly 20 through a series of side wall slots 186 formed in the starter housing 30. The air 184 entering the powerhead assembly interior is forced rightwardly across the finned cylinder 100 and the muffler 118, through the lower rear shroud cavity 74, to cool the same. Cooling air 184 rightwardly traversing the muffler 118 mixes with exhaust gas 186 being discharged therefrom to cool such exhaust gas. The cooling air-exhaust gas mixture 184, 186 is then discharged rearwardly from the muffer guard 160, through the rear end wall perforations 158 therein, as illustrated in FIG. 3. This conveniently directs the cooled exhaust gas-cooling air mixture rearwardly away from the trimmer operator.

Affixed to the inner end of the crankshaft section 172 is a crankshaft counterweight member 188 which is disposed within the rear portion 122 of the crankcase 106. This counterweight section of the crankshaft assembly 104 is provided with a crank pin 190 which is operatively interconnected with the piston 102 by a connecting rod 192.

The clutch assembly 112 is coaxially mounted on an outer end portion of the crankshaft section 180 and is retained thereon by a nut 194 fastened onto the threaded crankshaft end portion 182. An annular clutch washer 196 is also coaxially mounted on the shaft section 180 and bears against the rear side surface of the clutch assembly 112. An inner end portion of an elongated flywheel counterweight member 198 is slidably retained on the shaft section 180 and bears against a central from side surface portion 200 of the flywheel 108. Counterweight 198 is captively retained on the shaft section 180, and held in abutment with the flywheel surface 200, by a tubular retainer sleeve 203 mounted on the shaft section 180 and bearing at its opposite ends against the clutch washer 196 and the counterweight 198.

The counterweight member 198 functions to substantially reduce engine vibration attributable to linear inertia and reactive forces of the piston 102, the connecting rod 192, and their associated connecting structure, imposed upon the right end of the crankshaft when the piston 102 is adjacent its top dead center and bottom dead center positions. Counterweight 198 is aligned on the flywheel 108 in a manner such that when the piston is adjacent these positions, the longitudinal axis of the counterweight is swung through a parallel relationship with the piston axis and exerts an appropriately directed counterforce on the crankshaft to offset the rocking torque imposed on the right crankshaft end by these linear inertial and reactive forces. To maintain the counterweight member 198 in appropriate alignment with the flywheel 108, an outer end portion of the counterweight 198 is received and retained between an appropriate adjacent pair of the flywheel impeller blades 110.

In a conventional fashion, the flywheel 108 has a magnet (not illustrated) imbedded in a circumferential portion thereof which is rapidly driven past the ignition module 114 to transmit an electrical spark, via the wiring 144, to the spark plug 116. A snap-action electrical kill switch 201 (FIGS. 1 and 2) is mounted on the top of the fan housing 26 and is suitably interconnected to the wiring 144 (in a manner not illustrated) to selectively and rapidly terminate engine operation. As illustrated in FIG. 3, the downwardly projecting spark plug 116 is rearwardly adjacent a downwardly projecting front guard and support section 202 of the main shroud 24. The section 202 functions both as a support for the powerhead assembly 20 when it is rested upon the ground, and further shields the outwardly projecting spark plug from damage.

The starter housing 30 defines a portion of a manual starter assembly 204 which includes a starter pulley 206 rotatably mounted on the starter housing support post 88. Pulley 206 is operatively connected to a schematically depicted annular torsion spring element 208 which circumscribes the starter housing post 88 and is captively retained between the inner pulley flange 210 and the front wall 86 of the starter housing 30. Extending rearwardly from the outer pulley flange 212 is a central cylindrical drive hub 214 having formed around its periphery a series of ratchet drive teeth 216.

A starter rope 218 is operatively wrapped around the pulley 206 and has an outer end portion 220 which is passed outwardly through a grommeted opening 222 in the starter housing 30 and secured to a generally T-shaped starter pull handle. An inner end portion 226 of the rope is extended outwardly through a pulley threading opening 228 formed in the flange 212 and is knotted around or otherwise secured to the pulley drive hub 214.

In a conventional manner, as the handle 224 is pulled upwardly as viewed in FIG. 3, the resulting extension of the starter rope 218 rapidly rotates the pulley 206, thereby winding up the torsion spring 208. The drive hub teeth 216 simultaneously engage spring-loaded starter dogs 230 on the flywheel 108 to rotationally drive the flywheel, and thus the crankshaft, to start the engine. Upon engine startup, the dogs 230 are centrifugally swung out of engagement with the starter teeth 216 to thereby disconnect the starter assembly from the balance of the engine. When the handle 224 is released, the tightened torsion spring 208 operates to rewind the starter rope 218 on the pulley 206 as illustrated in FIG. 3.

The clutch housing 32 defines a portion of a drive and coupling assembly 232 which functions in cooperation with the clutch assembly 112 to transmit rotational power from the engine 22 to the trimmer cutting head 14 (FIG. 1) through a flexible drive shaft 234 disposed within the trimmer shaft 12 within a liner structure 238. This flexible drive system, which forms no part of the present invention, is similar to that illustrated and described in U.S. Pat. No. 4,451,983.

Drive and coupling assembly 232 includes a clutch drum 240 which, as illustrated in FIG. 3, is disposed within a rear portion of the clutch housing 32, has an open rear end, and outwardly circumscribes the clutch assembly 112. A radially reduced front side wall 242 of the clutch drum 240 is rotationally locked to a flanged portion 244 of a hollow tubular connector member 246 which projects axially inwardly into the support shaft 94 and into an inner end portion $12_a$ of the trimmer shaft 12 which is also received within such support shaft 94. The connector member 246 is rotatably supported within the hollow support shaft portion 94 of the clutch housing 32 by means of an annular bearing 248 which, like an adjacent annular bearing washer 250 is conveniently molded-in with an inner end portion of the support shaft 94. The molded-in bearing and washer 248, 250 are captively retained within an inner end portion of the support section 94 by a pair of annular lip flanges 252, 254 formed therein.

The tubular connector member 246 is captively retained on the support element 94 by means of the shoulder portion 244 positioned on one side of the bearing 248, and a suitable snap ring member 256 secured to the member 246 and positioned on the opposite side of such bearing. The inner end portion 256 of the flexible drive shaft 234 is slidably received within a complementarily configured axial opening within the forward end of the connector member 246 to thereby rotationally lock the shaft 234 and the connector member 246.

An inner end portion $12_a$ of the trimmer shaft 12 is keyed or otherwise rotationally locked within the cylindrical support portion 94 of the clutch housing 32 to prevent relative rotation therebetween. As best illustrated in FIG. 2, the outer end of the clutch housing 32, which removably receives the inner end portion 12*a* of the trimmer shaft 12, is axially slit, as at 258, along a central portion thereof. The inner trimmer shaft end portion $12_a$ is releasably clamped within the outer end portion of the clutch housing 32 by means of two clamp screws 260 which are extended through upper and lower front portions 262 and 264 of the clutch housing 32, disposed on opposite sides of the slit 258, to draw such portions together around the trimmer shaft end portion $12_a$.

The clutch assembly 112 is of a generally conventional construction and includes a central hub portion 266 and a pair of friction elements 268 which are normally biased to their radially inwardly retracted positions depicted in FIG. 3 by clutch spring means 270 which circumscribe the hub 266 and operatively engage the friction elements 268. When the engine 22 reaches a predetermined rotational speed, the friction elements 268 are forced centrifugally outwardly from the hub 266 into frictional engagement with the interior surface of the clutch drum 240 to rotate the drum and, via the locked interconnection between the connector member 246 and the flexible shaft end portion 256, to transmit rotational power from the engine 22 through the flexible drive shaft 234 to the trimmer head 214. When the engine speed falls below this predetermined level, the clutch spring means 270 overcome the centrifugal force on the friction elements 268 to thereby withdraw them from frictional engagement with the clutch drum 240 and decouple the flexible drive shaft 234 from the engine 22.

Returning now to the discussion of the various advantages provided by the uniquely configured shroud 24, it can be seen in FIGS. 1, 2 and 5 that the carburetor 46 and its associated filter and choke plate assembly 120 are conveniently disposed and protected within the rear shroud recess 76 defined by vertically opposed rear sections of the shroud. Disposed in recess 76 in this manner, these components are quite well protected by outer surface portions of the shroud 24 from damage. They remain, however, quickly and easily accessible for service and maintenance. For example, as previously described, both the carburetor 46 and the filter and choke assembly 120 may be quickly removed from the shroud simply by removing the two screws 166 and the two screws 168 (see FIGS. 4 and 8) which are easily accessible from the rear of the shroud. Additionally, while the carburetor 46 is securely protected within the shroud recess 76, its idle, high speed and low speed adjustment screws 272, 274 and 276 (FIG. 5) may be easily screwdriver-adjusted from the side of the shroud 24 without the necessity of removing any associated components, cover plates or the like.

The shroud 24, as best illustrated in FIG. 3, also conveniently forms a bottom portion of a top-mounted gas tank 278 which holds a supply of gasoline for delivery to the carburetor 46 via the flexible fuel line 170. The upper shroud wall 58 is provided around its periphery with an upstanding flange portion 280 which defines with the wall 58 a downwardly inset well portion 282 positioned at the top 284 of the shroud 24. To form with the well 282 the balance of the top-mounted gas tank 278, a molded plastic tank cover element 286, provided with a screwed on gas cap 288, is vibratory welded at its open lower end 290 to the upper end of the well flange portion 280. The flexible fuel line 170 is passed upwardly through a suitably sealed opening (not shown) formed in the lower tank wall 58, and is provided at its upper end with a weighted fuel inlet filter element 292.

It can be seen from the foregoing that the uniquely configured main shroud portion 24 of the power head assembly 20 forms a convenient and multi-functional "base" to which the other power head assembly components, including the "stacked" housing sections 26, 30 and 32, are connected and supported from. These stacked housing structure elements uniquely cooperate with the main shroud 24 to provide substantially improved maintenance, service and replacement access to the engine 22 disposed within and supported on the shroud in a manner which will now be described.

Rapid access to the clutch assembly 112 is achieved simply by removing the four mounting screws 34 (FIG. 2) and pulling the drive and coupling assembly 232 leftwardly away from the balance of the power head assembly, thereby exposing the clutch assembly 112 which is conveniently held in place by the nut 194. The friction elements 268 of the clutch may then be inspected, and serviced or replaced as necessary. At the same time, the clutch drum 240 may be easily inspected. If it is necessary to remove the drive and coupling assembly 232 from the trimmer shaft to which it is still clamped, the clamping screws 260 (FIG. 2) may be simply loosened to permit the drive and coupling assembly 232 to be simply pulled rightwardly off the trimmer shaft end portion $12_a$.

It will be noted that when the drive and coupling assembly 232 has been removed from the starter housing 30, the exposed clutch assembly 112 conveniently retains the starter assembly 204 on the crankshaft. If it is required to inspect the interior of the assembly 204, all that is necessary is to remove the crankshaft end nut 194, slide the clutch assembly leftwardly off the crankshaft, and then similarly slide the starter assembly 204 leftwardly off the crankshaft.

Access to the entire flywheel 108, and the ignition module 114, may then be provided simply by removing the screws 28 (FIG. 2) and then removing the fan housing 26. After the fan housing 26 has been removed in this manner, the entire assembled balance of the engine 22 may be removed simply by removing the four engine mounting bolts 134 (FIG. 4), and the spark plug 116, and then pulling the disconnected engine outwardly through the open front end 56 of the shroud 24. In a similarly rapid fashion, the carburetor 46 and the filter and choke plate assembly 120 may also be removed by removing the screws 166 and 168 (FIG. 4). Reassembly of the power head 20 is easily achieved simply by essentially reversing these steps.

Figure 6A:
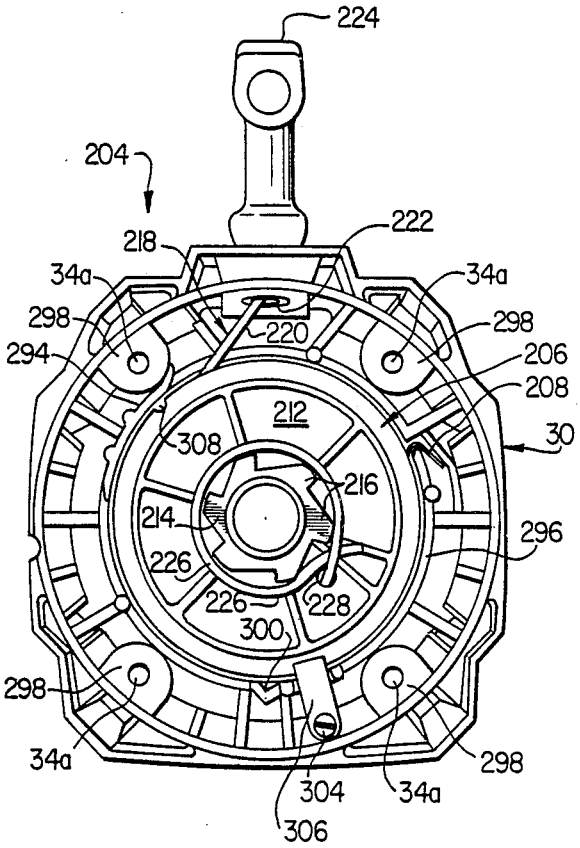
FIGS. 6A and 6B are rear side elevational views of the starter housing portion of the power head section, taken along line 6—6 of FIG. 4, illustrating certain structural and operational features of the recoil starting mechanism disposed therein.
Figure 6B:
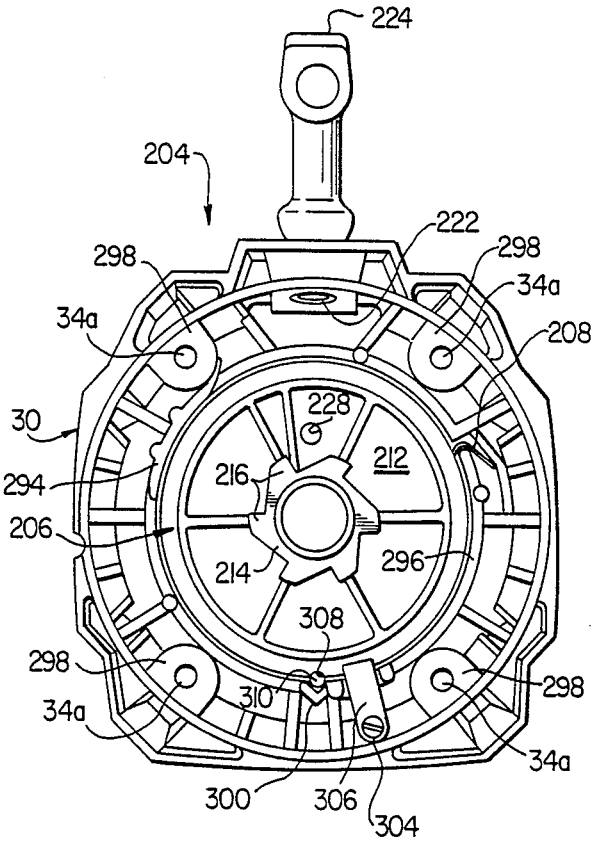

Referring now to FIGS. 6A and 6B, the previously described starter assembly 204 is of a unique design which substantially facilitates and renders a great deal safer the initial or subsequent repair installation of a starter rope 218. The starter rope pulley 206 coaxially mounted on the pulley drive hub 214 is received within arcuate guide structure defined in part by axially extending, curved guide moldings 294, 296 which are positioned radially inwardly of four circumferentially spaced molded boss sections 298, each of the bosses 298 having a circular opening **34*a* formed axially therethrough for receiving one of the four mounting screws 34 (FIG. 2**).

Formed on a left end portion of the guide molding 296 is a radially outwardly projecting, generally V-shaped groove 100, the right end of the molding 296 being used to retain the radially outermost end of the torsion spring 208. A thickened portion 302 (FIG. 3) of the starter housing 30 is positioned radially outwardly of the guide molding 296 and has secured thereto, by means of a small screw 304, an elongated pulley retaining tab member 306. As illustrated in FIGS. 6A and 6B, a radially inner end portion of the tab 306 overlies a radially outer surface portion of the outer pulley flange 212, thereby precluding axial dislodgment of the pulley 206 from the drive hub 214. For purposes later described, a small semicircular notch 308 is formed in the outer periphery of the outer pulley flange 212.

With the manual starter assembly 204 removed from the power head assembly 20 as previously described, the starter rope 218 may be replaced in the following safe, rapid and convenient manner. For purposes of describing this procedure, it will be assumed that the starter rope 218 depicted in FIG. 6A has become worn and needs to be replaced. To accomplish this replacement, the worn rope 218 is first removed from the pulley and discarded. Next, the pulley 206 is hand wound to fully tighten the torsion spring 208 and then backed off approximately one turn until the pulley flange edge notch 308 is brought into alignment with the guide molded V-groove 300 as illustrated in FIG. 6B. During this manual winding of the pulley 208, and thereafter, the tab 306 functions to hold the pulley 206 on the hub 214 to prevent the spring 208, when under torsion from flying off and injuring the installer of the new starter rope.

When the groove 300 and the notch 308 are brought into alignment as depicted in FIG. 6B, a suitable pin element 310 is axially inserted into the space between the groove and notch 300 and 308 to thereby lock the pulley against rotation caused by the wound up torsion spring 208. With the pin element 310 inserted in this manner, the pulley may be released, thereby freeing both hands of the rope installer to install a new starter rope.

When the pulley is temporarily locked in this manner, the pulley threading hole 228 is brought into circumferential alignment with the grommeted rope opening 222. The outer end of a new starter rope is then secured to the starter pull handle 224, and the inner end of the rope is threaded inwardly through the grommeted opening 222, into the space between the pulley flanges, outwardly through the threading opening 228 and then secured around the drive hub 214 as depicted in FIG. 6A. It is important to note that during this threading and attachment procedure, both of the operator's hands are free due to the locking action of the pin element 310, and the wound up spring 208 is safely prevented from escape by the action of the retaining tab 306.

All that is necessary now is to hold a section of the new rope, and a portion of the housing 30 adjacent the grommeted opening 222 with one hand while removing the pin elements 310 with the outer. The section of the new rope disposed outwardly of the housing may then be allowed to slide through the fingers while the torsion spring 208 unwinds to automatically rewind the new rope 218 onto the pulley 206 and pull the handle 224 back against the housing 30 as illustrated in FIG. 6A. It can readily be seen that the significant safety and maintenance improvement achieved in the improved starter assembly 204 is provided by the present invention at a very low cost—namely, the cost of providing the groove 300, the notch 308, the screw 304 and the retainer tab 306.

Figure 7:
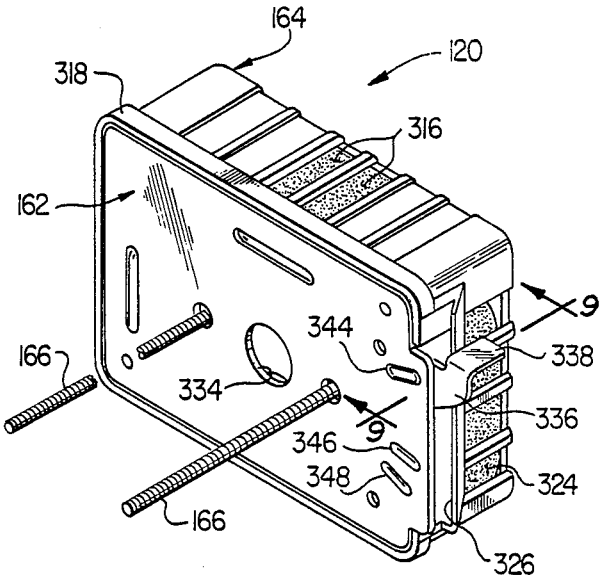
FIG. 7 is an enlarged scale perspective view of a choke plate and air filter subassembly portion of the power head section.
Figure 8:
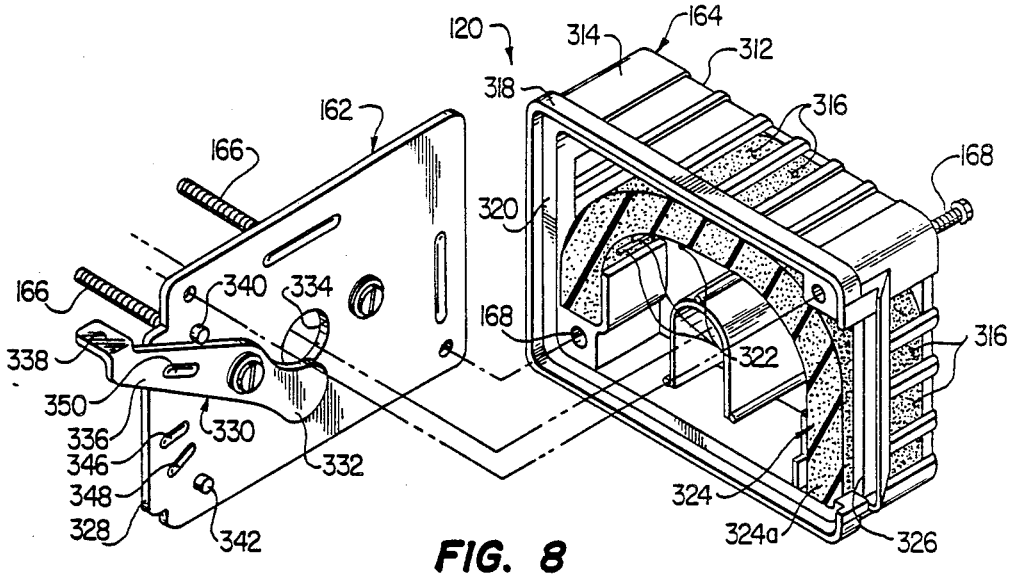
FIG. 8 is an exploded perspective view of the subassembly of FIG. 7.
Figure 9:
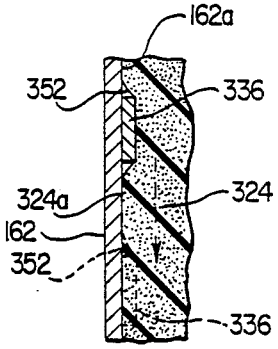
FIG. 9 is an enlarged scale fragmentary cross-sectional view through the subassembly of FIG. 7, taken along line 9—9 thereof.

Another of the various improvements incorporated in the trimmer 10 by the present invention relates to the structure and operation of the filter and choke plate assembly 120 depicted in FIGS. 7–9. The filter housing 164 has an elongated, generally rectangular configuration; an open front end; a back wall 312; a side wall portion 314 having a series of air inlet openings 316 formed therein; a peripheral, forwardly projecting flange 318 bordering the open front end; and a rearwardly inset peripheral ledge 320 inwardly adjacent the flange 318. Projecting forwardly from the back wall 312 is an arcuately disposed series of spaced apart support pins 322 around which a strip of foam type air filter material 324, disposed within the filter housing 164, is bent. A forward right end portion of the housing 164 has a notch 326 formed therein, the notch extending rearwardly of the ledge 320.

The choke plate 162 is closely received within the flange 318 and drawn into abutment with the ledge 320 by the screws 168, an end tab portion 328 of the plate 162 being received in a forward side portion of the notch 326. A central portion of an elongated, plate-like choke lever 330 is pivoted to the rear surface of the choke plate 162 by one of the mounting screws 166 so that an inner end portion 332 of the lever 330 can be selectively pivoted over all or a portion of a central circular choke opening 334, formed through the plate 162, to selectively choke the engine 22.

The choke lever 330 has an outer end portion 336 which projects outwardly beyond the end tab portion 328 of the plate, and is provided at its outer end with a forwardly bent end tab portion 338 which may be easily manipulated by a finger to selectively pivot the lever 330. The pivotal motion of the lever 330 is limited by rearwardly projecting stop pin portions 340 and 342 on the plate 162, while suitable detent depressions 344, 346 and 348 are formed in the rear surface of the plate 162. These detent depressions cooperate with a complementarily configured detent projection 350 on the outer choke lever end portion 336 to conveniently hold the lever in one of three selected choke positions.

With the choke plate 162 firmly secured to the filter housing 164 as previously described, a front side edge portion $324_a$ of the foam filter strip 324, adjacent the filter housing notch 326, is pressed against the inner side surface $162_a$ of the plate 162 and is also pressed around the outwardly projecting end portion 336 of the choke lever 330 (see FIG. 9) to maintain a movable dust seal 352 around the outwardly projecting choke lever portion 336. As illustrated in FIG. 9, when the lever portion 336 is moved downwardly from its solid line position to its dotted line position, the seal 352 moves with the lever portion, so that the portion of the filter element side surface $324_a$ previously depressed by the lever portion 336 in its solid line position moves back into engagement with the inner side surface $162_a$ of the plate 162. The cooperation in this manner between the foam filter element 324 and the lever 330 substantially reduces the amount of unfiltered air which eventually reaches the carburetor 46.

Figure 10:
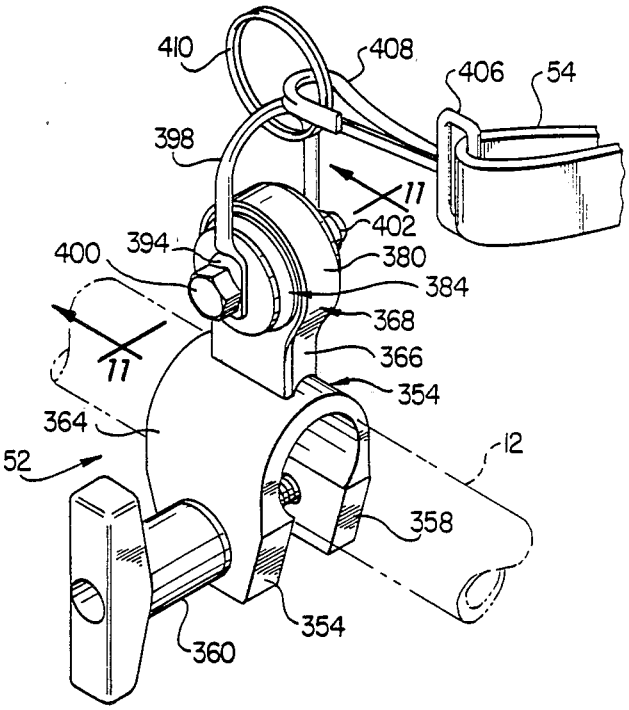
FIG. 10 is an enlarged scale perspective view of a vibration isolating shoulder strap connecting member secured to a portion of the trimmer shaft which is illustrated in phantom.
Figure 11:
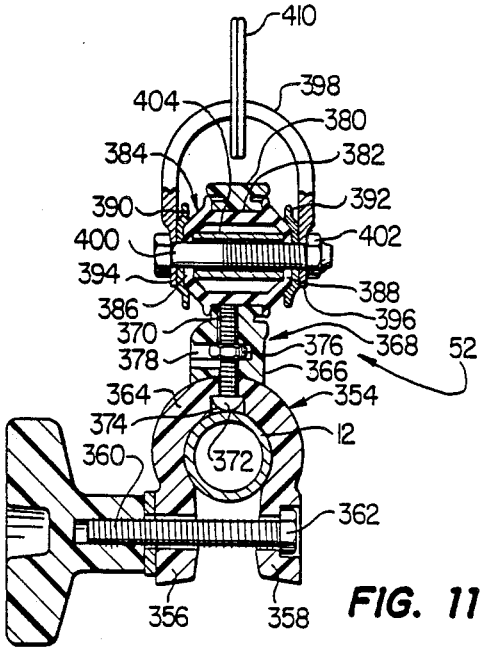
FIG. 11 is a cross-sectional view through the connecting member taken along line 11—11 of FIG. 10.

Yet another aspect of the present invention resides in the structure and operation of the shoulder strap connector assembly 52 which will now be described with reference to FIGS. 10 and 11. While it might be assumed that, due to the inherent flexibility of the shoulder strap 54, that shaft vibration transmitted to the trimmer user therethrough would be rather minimal, a surprisingly high amount of shaft vibration is actually transmitted to the user through such strap 54 when it is connected to the conventional rigid clamp member typically used to connect an outer end portion of the strap to the shaft. A substantial amount of this annoying and sometimes tiring shaft vibration transmitted through the strap 54 is, however, eliminated by the resilient connector assembly 52 which comprises a generally U-shaped molded plastic clamp portion 354 whose depending arms 356, 358 project below the trimmer shaft 12 and are drawn together by a clamp screw and locking nut assembly 360, 362 to draw the curved base portion 364 of the clamp member 354 tightly against the shaft 12. The projecting base portion 366 of a molded plastic connector member 368 is anchored to the closed top of base portion 364 by means of a radially extending screw 370 which extends upwardly through aligned bores formed in the base portions 364 and 366, has a head 372 received in a radially inner surface depression 374 in the base portion 364, and is threaded into a lock nut 376 which is positioned along a longitudinally intermediate portion of the screw 376 and is received in a recess 378 formed in the base portion 366 as illustrated. Alternatively, of course, the clamp portion 354 and the connector member 368 could be molded integrally with one another if desired.

The connector member 368 has an annular upper end portion 380 having a radially inner portion captively retained in an annular, exterior surface channel 382 formed around the side surface of a hollow, generally barrel shaped vibration isolator member 384. Isolator member 384 is formed from a suitable resilient elastomeric material and has tapered opposite ends 386, 388 which are respectively received in generally dish-shaped isolator support members 390 and 392 that are inwardly adjacent the lower ends 394, 396 of a U-shaped metal snap connector member 398.

Member 398 is secured to the resilient isolator member 384 by means of a connecting bolt 400 which extends through the onnector member ends 394 and 396, the dish-shaped members 390 and 392, the tapered ends 386 and 388 of the isolator 384, and axially through the interior of the isolator. The outer end of the bolt 400 is threaded into a suitable retaining nut 402. Instead of the bolt 400, another suitable type of fastening member, such as a rivet, could be utilized if desired.

A tubular metal spacer member 404 is positioned within the interior of the isolator 384, coaxially circumscribes a longitudinally central portion of the bolt 400, and bears at its opposite ends against the interior surfaces of the outer ends 386, 388 of the isolator 384. The illustrated looped outer end portion of the shoulder strap 54 is passed through the rectangular slide loop end portion 406 of a small clip member 408 which may be clipped directly onto the snap connector member 398 or, as illustrated, be clipped onto a split ring adapter member 410 which is in turn connected to the member 398.

It can be seen that the snap connector member 398 is completely isolated from the base portion 366 of the connector member 368 by means of the hollow vibration isolator member 384 which, due to its hollow configuration, may be flexed axially and/or radially. Accordingly, a substantial portion of the shaft vibration which would otherwise be transmitted from the clamp member 354 through the connecting structure to the shoulder strap 54 is absorbed and damped by the isolator member 384.

Figure 12:
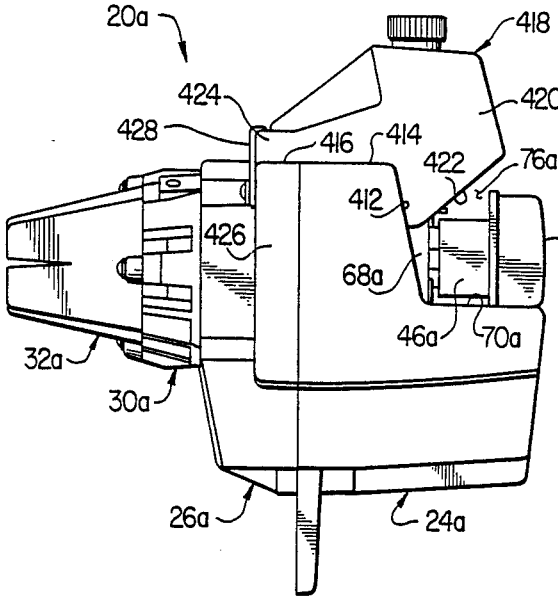
FIG. 12 is a side elevational view of an alternate embodiment of the power head section.

Illustrated in FIG. 12 is an alternate embodiment $20_a$ of the previously described power head assembly 20. For ease of comparison, components in the assembly $20_a$ similar to those in the assembly 20 have been given identical reference numerals, but with the subscript "a". The engine and clutch components disposed within the shroud and housing structure $24_a$, $26_a$, $30_a$ and $32_a$ are identical to those in the powerhead assembly 20, and the engine is provided with an externally mounted filter housing and choke plate assembly $120_a$ and an associated carburetor $46_a$ mounted to the thickened shroud support wall section $68_a$.

However, in the assembly $20_a$ the protective recess $76_a$ at the back end of the main shroud $24_a$ is not defined entirely by the shroud itself. Instead, the shroud $24_a$ is provided with a forwardly and upwardly sloping upper rear wall portion 412 which extends between the inner end of the intermediate wall $70_a$ and an essentially flat, forwardly disposed top wall portion 414 which is immediately adjacent a flat upper top wall portion 416 of the fan housing $26_a$. Additionally, the modified shroud $24_a$ does not integrally define a portion of the gas tank section of the powerhead assembly. Instead, a separate molded plastic gas tank 418 is provided and sits atop the shroud and fan housing top wall portions 414, 416. Tank 418 has a rear portion 420 which projects rearwardly of and extends downwardly along the shroud wall 412. The rear tank portion 420 has a rearwardly and upwardly sloped rear bottom wall portion 422 which, with the shroud walls $68_a$ $70_a$ defines the protective recess $76_a$. Tank 418 has a front side portion 424 which is secured to a rear shoulder portion 426 of the fan housing $26_a$ by a suitable connecting bracket structure 428. The rear tank portion 420 may be additionally secured to the sloping shroud wall 412 by suitable interlocking lip means (not illustrated) if desired.

Figure 13:
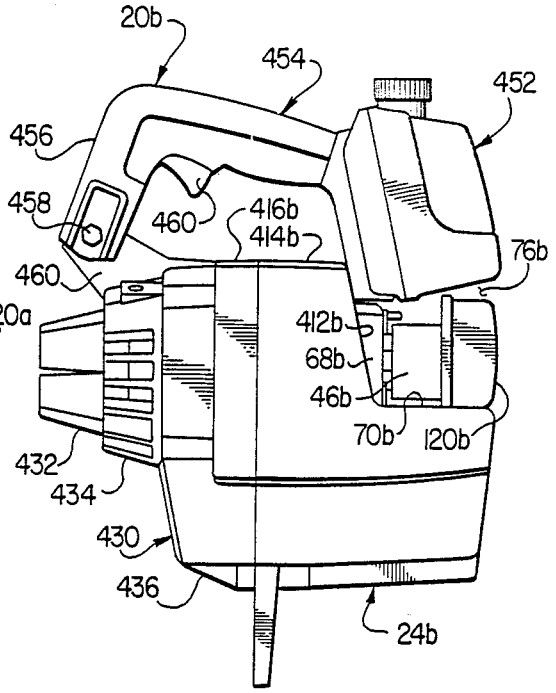
FIG. 13 is a side elevational view of a further alternate embodiment of the power head section.

A further alternate embodiment $20_b$ of the power head assembly 20 is depicted in FIG. 13. The power head assembly $20_b$ is a direct drive (i.e., non-clutch) version of the assembly 20 and has a variety of other modifications made thereto. The shroud $24_b$ is substantially identical to the shroud $24_a$ described in conjunction with FIG. 12, but instead of having separate fan, starter and clutch housings removably secured thereto in a "stacked" fashion, the shroud $24_b$ has forwardly secured thereto a single housing structure 430 having, from front-to-rear, coupling, starter and fan sections 432, 434 and 436 molded integrally with one another. The unitary housing structure 430 is similar in appearance to the stacked separate housings $26_a$, $30_a$ and $32_a$ of FIG. 12, but the coupling section 432 is shorter, in a front-to-rear direction, due to the absence of a clutch in the power head assembly $20_b$.

Figure 14:
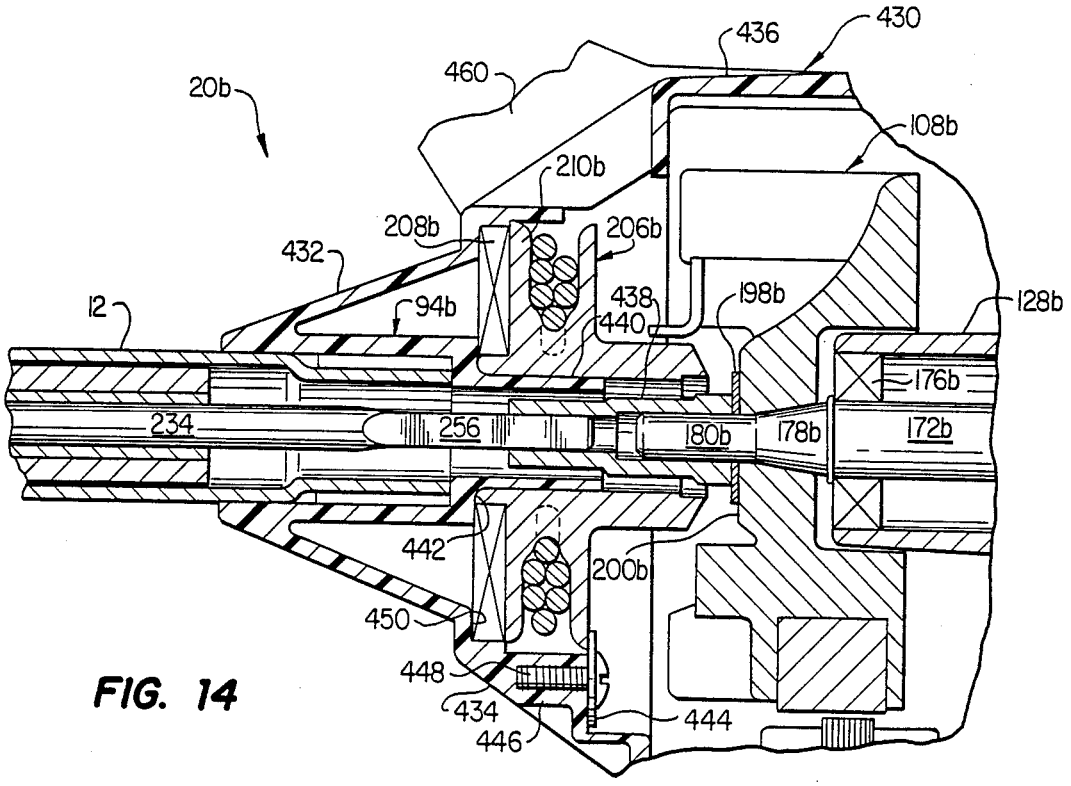
FIG. 14 is an enlarged scale partial cross-sectional view through a front end portion of the power head section of FIG. 13.

Referring now to FIG. 14, it can be seen that the flywheel $108_b$ is disposed within the fan section 436, and the starter pulley $206_b$, and its associated torsion spring $208_b$ are disposed within the starter section 434 of the unitary housing structure 430. In this non-clutch version of the power head assembly, the outer end portion $180_b$ of the crankshaft is considerably shortened, and projects outwardly a short distance from the central flywheel surface $200_b$ against which the flywheel counterweight $198_b$ is disposed. The crankshaft end portion $180_b$ is rotationally locked within a right end portion of a hollow tubular coupling member 438 which extends coaxially into the inner end of the support shaft portion $94_b$ of the coupling section 432. The left end of the coupling member 438 nonrotatably receives the square end 256 of the flexible drive shaft 234, the trimmer shaft 12 being clamped within the coupling section 432 as previously described in conjunction with the clutch housing 32 of power head assembly 20. In this embodiment of the power head assembly, the flywheel counterweight $198_b$ is captively retained against the flywheel surface $200_b$ by the right end of the coupling member 438.

The starter pulley $206_b$ is mounted on a reduced diameter inner end portion 440 of the support shaft $94_b$ (which replaces the support post 88 described in conjunction with FIG. 3) and is held in abutment along its forward end with a shoulder portion 442 of the shaft $94_b$ by a washer 444 or other suitable retaining member fastened to a thickened housing wall portion 446 by a small screw 448. The torsion spring $208_b$ is captively retained between the pulley flange $210_b$ on one side, and the shoulder 442 and an internal housing shoulder 450 on the other side. It can be seen in FIG. 14 that very rapid access to both the starter assembly, the flywheel, and the balance of the engine may be achieved simply by removing the unitary housing structure 430 from the main shroud $24_b$. Starter rope replacement may be easily and safely accomplished in the manner previously described in conjunction with FIGS. 6A and 6B.

Another modification made to the power head assembly $20_b$ is that (as in the case of the assembly $20_a$) the shroud $24_b$ is not utilized to integrally define a portion of the gas tank section of the powerhead assembly $20_b$. Instead, a separate molded plastic gas tank 452 is provided and suitably secured to the rear end of a generally L-shaped operator handle 454 which is spaced upwardly from the shroud and housing wall portions $414_b$ and $416_b$. The tank 452 is suitably secured to the shroud wall portion $412_b$ and overlies the filter and choke plate assembly $120_b$ and the carburetor $46_b$ to thereby partially define the protective recess $76_b$ in which such components are received. A downwardly bent forward end portion 456 of the handle 454 is suitably secured, as at 458, to a support web 460 molded integrally with the housing structure 430, and projecting forwardly and upwardly therefrom at an upper end portion of its starter and fan sections 434 and 436.

The handle 454 is provided with a pivotally mounted throttle trigger 460 adjacent the forward handle end 456, the trigger 460 being operatively interconnected (in a mnnner not illustrated) to the carburetor throttle arm via suitable cable means. It will be appreciated that when this particular embodiment of the power head assembly is utilized, the handle 454 functions as a rear operator control handle so that the cylindrical handgrip 36, and its associated throttle control structure depicted in FIG. 1, could be eliminated when this power head assembly embodiment is incorporated into the trimmer 10.

By comparing the previously described power head assemblies 20, $20_a$ and $20_b$, it can readily be seen that each is constructed in a unique "modular" fashion which is both very cost effective and significantly enhances the ease with which it may be initially fabricated and assembled, and subsequently disassembled, either partially or totally, for maintenance, inspection and repair purposes. Because of this unique modular construction, access to the internal components of the power head is also greatly improved so that the tool purchaser can much more easily perform most of the ordinary maintenance, repair, and component replacement tasks.

Referring again to FIGS. 3 and 4, the readily separable "modules" of power head assembly 20 (which, from a modularity standpoint, is identical to the assembly $20_a$ of FIG. 12) include: an engine module comprising the shroud 24 and the engine 22 secured thereto; a fan housing module comprising the fan housing 26; a starter module defined by the starter assembly 204; and a coupling module defined by the drive and coupling assembly 232.

In the direct drive version $20_b$ of the power head assembly depicted in FIG. 13, there are two readily separable modules—the engine module defined by the somewhat modified shroud $24_b$ and the engine secured thereto, and a combined fan housing, starter and coupling module defined by the integral front housing structure 430 and the previously described starter and coupling structure carried therein and removable therewith. In comparing the power head assemblies 20 and $20_b$, the fan housing, starter and coupling modules of assembly 20 may be conceptually characterized as submodular counterparts of the single fan housing, starter and coupling module of assembly $20_b$ provided in part, to accomodate the presence of the clutch assembly 112.

From the foregoing it can be seen that the present invention, in the described illustrative embodiments thereof, provides a portable rotary power tool which is substantially improved in a variety of manners relating to structure, operation, maintenance and service accessibility, cost reduction and overall operating convenience and comfort. It will be appreciated, however, that the principles of the present invention are not limited to the particular type of power tool depicted herein, and could be employed in a wide variety of alternate applications.

The foregoing detailed description is to be clearly understood as being given by way of illustration and example only, the spirit and scope of the present invention being limited solely by the appended claims.

What is claimed is:

1. An internal combustion engine driven power tool comprising working means drivable to perform a predetermined work function; power transmitting means for receiving rotational power from a source thereof and responsively transmitting the received power to said working means to drive the same; and a power head assembly including:

a shroud member having an open front end, an engine support wall section spaced rearwardly from said open front end, a fuel-air mixture passage extending through said support wall section from an exterior surface thereof to an interior surface thereof, a reed valve operatively secured to said inner surface of said support wall section over said fuel-air mixture passage, and a chamber extending rearwardly of said support wall section, said chamber communicating with the interior of said shroud member and having a rear end opening;

an internal combustion engine for generating rotational power, said engine being partially enveloped by said shroud member and having a crankcase with an open rear end portion interiorly secured to said support wall section over said reed valve so that said support wall section defines a rear closure wall of said crankcase, the balance of said engine being supported from said crankcase, said engine further having a cylinder connected to a side portion of said crankcase within said shroud member, a muffler secured to said cylinder and positioned within said chamber, and a carburetor externally secured to said support wall section and operatively positioned over said fuel-air mixture passage;

housing means removably connectable to said shroud member over said open front end thereof;

coupling means, positioned within said housing means, for rotationally coupling said engine to said power transmitting means; and manually operable starter means, internally carried by a portion of said housing means for removal therewith from said shroud member, for starting said engine.

2. The power tool of claim 1 wherein:

said shroud member has an inset exterior wall portion, and said power tool further comprises a shell member having an open end portion secured to and sealed around the periphery of said inset exterior wall portion to define therewith a fuel tank portion of said power head assembly.

3. The power tool of claim 1 wherein:

said shroud member has a pair of spaced apart exterior wall portions which, with said support wall section, define in said shroud member an exterior recess in which said carburetor is received, said exterior wall portions laterally and rearwardly overhanging said carburetor in a manner protecting it from damage yet permitting access thereto from the exterior of said shroud member.

4. The power tool of claim 3 further comprising:

air filter means carried by said carburetor within said recess for filtering air received by said carburetor.

5. The power tool of claim 1 wherein:

said housing means comprise a single housing member, said engine has a crankshaft having an outer end disposed within said single housing member, said single housing member has a tubular support shaft portion therein which is axially aligned with said outer crankshaft end and positioned forwardly thereof, said coupling means include a coupling member disposed within said support shaft portion and rotationally coupling said outer crankshaft end and said power transmitting means, and said starter means include a starter rope pulley coaxially retained on said support shaft portion for rotation relative thereto.

6. The power tool of claim 1 wherein:

said housing means comprise first, second and third housing sections releasably connected to each other and to said front end of said shroud member, said first housing section being forwardly contiguous with said front end of said shroud member, said second housing section being forwardly contiguous with said first housing section, said third housing section being forwardly contiguous with said second housing section, said engine has a crankshaft extending forwardly from said crankcase through said first and second housing sections and having an outer end portion disposed in said third housing section and having a centrifugal clutch assembly captively and releasably retained thereon, and a flywheel rotationally locked on said crankshaft and disposed within said first housing section, said starter means include a starter rope pulley coaxially circumscribing said crankshaft and rotatably retained within said second housing section for removal therewith, and said coupling means include clutch drum means, rotatably carried within said third housing section for removal therewith, for being frictionally engaged and rotationally driven by said centrifugal clutch assembly when the rotational speed of said engine reaches a predetermined magnitude.

7. An internal combustion engine driven power tool comprising working means drivable to perform a predetermined work function; power transmitting means for receiving rotational power from a source thereof and responsively transmitting the received power to said working means to drive the same; and modular power head means for supplying rotational power to said power transmitting means, said modular power head means including:

an engine module comprising a shroud member having an open front end, and an internal combustion engine secured to and supported by a wall section of said member, said engine having crankcase and cylinder portions disposed within said shroud member and removable through said open front end thereof, a crankshaft having a front longitudinal portion projecting forwardly from said open front end of said shroud member and having an outer end portion, and a flywheel coaxially carried on and rotationally locked to said front longitudinal portion of said crankshaft;

a housing section removably connected to said open front end of said shroud member and enclosing said flywheel and said front longitudinal portion of said crankshaft;

coupling means, positioned within said housing section, for rotationally coupling said engine to said power transmitting means; and manually operable starter means, carried by said housing section for removal therewith from said shroud member, for starting said engine.

8. The power tool of claim 7 wherein:

said housing section, said starter means, and said coupling means are associated to define a fan housing, starter and coupling modules which are releasably connected to one another in a forwardly-to-rearwardly stacked assembly releasably secured to said open end of said shroud member, said fan housing module comprising a first portion of said housing section which is forwardly contiguous with said open front end of said shroud member and circumscribes said flywheel, said starter module comprising said second portion of said housing section carrying said starter means for removal therewith and being forwardly contiguous with said first housing section portion, said coupling module comprising a third portion of said housing section internally carrying said coupling means for removal therewith and being forwardly contiguous with said second housing section portion.

9. The power tool of claim 8 wherein:

said engine has a centrifugal clutch assembly disposed within said coupling module and captively retained on said outer end portion of said crankshaft, said clutch assembly captively retaining said fan housing and starter modules on said shroud member and being removable from said outer crankshaft end portion to permit removal of said fan housing and starter modules from said shroud member, said third housing section has a tubular support shaft disposed therein, said support shaft portion having bearing means coaxially carried therein, and said coupling means include a coupling member captively retained in said support shaft portion, rotatably supported by said bearing means, and rotationally coupled to said power transmitting means, and clutch drum means, carried by said coupling member for rotation therewith and outwardly circumscribing said centrifugal clutch assembly, for being frictionally engaged and rotationally driven by said clutch assembly when the rotational speed of said engine reaches a predetermined level.

10. The power tool of claim 9 wherein:

said power transmitting means include an elongated tubular shaft connected at its opposite ends to said working means and said powerhead means, and a flexible drive shaft extending through said tubular shaft and interconnecting said working means and said coupling member.

11. The power tool of claim 9 wherein:

said support shaft portion is of a molded material, and said bearing means are molded into a portion of said support shaft portion.

12. The power tool of claim 11 wherein:

said support shaft portion has a rear end portion with a pair of axially spaced, radially inwardly directed annular flanges thereon, and said bearing means are captively retained between said flanges and comprise an annular bearing and an annular bearing spacer.

13. The power tool of claim 8 wherein:

said flywheel has spring biased centrifugal starter dogs operatively mounted on a forwardly disposed portion thereof, said second housing section portion has a front wall circumscribing said crankshaft, a tubular support post circumscribing said crankshaft and projecting rearwardly from a central portion of said front wall, and a generally annular support section outwardly circumscribing said crankshaft and said support post and projecting rearwardly from said front wall, and said starter means include a starter pulley coaxially and rotatably carried on said support post within said support section and having front and rear flanges between which a starter rope may be wound, a torsion spring circumscribing said support post, operatively connected to said pulley and disposed between said front wall and said front flange, and a drive hub projecting rearwardly from said rear flange and having drive teeth adapted to operatively engage said flywheel starter dogs, and a retaining member removably secured to said second housing section portion and rearwardly overlying said rear flange in a manner captively retaining said pulley and said spring on said support post.

14. The power tool of claim 13 wherein said starter means further comprise:

alignable first and second depressions respectively formed in a peripheral portion of said rear pulley flange and in said support section, said depressions being relatively configured so that, when they are brought into circumferential alignment, a pin member or the like may be inserted therebetween to rotationally lock said pulley against the biasing force of said torsion spring to thereby facilitate the installation of a starter rope on said pulley.

15. The power tool of claim 7 wherein:

said housing section is a unitary housing member having an interior tubular support shaft portion projecting rearwardly from a front end thereof, and said coupling means include a coupling member projecting into the inner end of said support shaft portion and rotationally coupling said outer crankshaft end portion and said power transmitting means.

16. The power tool of claim 15 wherein:

said power transmitting means include an elongated tubular shaft connected at its opposite ends to said working means and said power head means, and a flexible drive shaft extending through said tubular shaft and interconnecting said working means and said coupling member.

17. The power tool of claim 15 wherein:

said flywheel has spring biased centrifugal starter dogs operatively mounted on a forwardly disposed portion thereof, said support shaft portion has a longitudinally central, annular, rearwardly facing exterior shoulder thereon, said housing member has an interior shoulder spaced laterally outwardly from and axially aligned with said support shaft portion shoulder, and said starter means include a starter pulley coaxially and rotatably mounted on a rear end portion of said support shaft portion, said pulley having front and rear flanges between which a starter rope may be wound, and a rearwardly projecting drive hub having teeth thereon adapted to operatively engage said starter dogs, a torsion spring circumscribing said support shaft portion, operatively connected to said pulley and captively retained between said shoulders and said front pulley flange, and a retaining member removably connected to said housing member and rearwardly overlying said rear flange in a manner captively retaining said pulley and said spring on said support shaft portion.

18. The power tool of claim 17 wherein:

said starter means further comprise circumferentially alignable depressions formed in said housing member and a peripheral portion of said rear pulley flange, and operative, when aligned, to have a pin member or the like inserted therebetween to rotationally lock said pulley against the biasing force of said spring to facilitate the installation of a starter rope on said pulley.

19. The power tool of claim 7 wherein:

said shroud member has a rear end recess formed therein, and said engine has an externally mounted carburetor protectively disposed within said recess.

20. The power tool of claim 19 wherein:

said engine has an air filter housing secured to said carburetor and also disposed within said recess.

21. The power tool of claim 7 wherein:

said shroud member has an external surface depression therein, and said power tool further comprises a shell member secured to said shroud member to define with said depression a fuel tank portion of said power tool.

22. The power tool of claim 7 wherein:

said shroud member has a front upper portion rearwardly bounded by an upper rear wall portion of said shroud member, and a lower rear portion projecting rearwardly from said upper rear wall portion, and said engine further includes a carburetor externally mounted on said upper rear wall portion, and a fuel tank mounted atop said front upper shroud portion and having a rear portion which overlies and protects said carburetor.

23. The power tool of claim 7 wherein:

said power head means further include an operator handle structure positioned above and interconnected between said shroud member and said housing section.

24. The power tool of claim 23 wherein:

said operator handle structure has a front end portion connected to said housing section, and a rear end portion defined by a fuel tank secured to said shroud member.

25. The power tool of claim 24 wherein:

said shroud member has a front upper portion rearwardly bounded by an upper rear wall portion of said shroud member, and a lower rear portion projecting rearwardly from said upper rear wall portion, said engine further includes a carburetor externally mounted on said upper rear wall portion, and said fuel tank is spaced upwardly from said lower rear shroud member portion and defines therewith a protective recess in which said carburetor is disposed.

26. The power tool of claim 25 wherein:

said engine further includes an air filter housing connected to a rear portion of said carburetor and disposed within said protective recess.

* * * * *